US008783594B2

(12) United States Patent
Scholz

(10) Patent No.: US 8,783,594 B2
(45) **Date of Patent: *Jul. 22, 2014**

(54) ROLLER MILL WITH DRIVEN GRINDING ROLLER

(76) Inventor: Guido Scholz, Münster (DE)

( * ) Notice: Subject to any disclaimer, the term of this patent is extended or adjusted under 35 U.S.C. 154(b) by 508 days.

This patent is subject to a terminal disclaimer.

(21) Appl. No.: 13/055,723

(22) PCT Filed: Aug. 24, 2009

(86) PCT No.: PCT/EP2009/060875

§ 371 (c)(1),
(2), (4) Date: Jan. 25, 2011

(87) PCT Pub. No.: WO2010/023180

PCT Pub. Date: Mar. 4, 2010

(65) Prior Publication Data

US 2011/0121118 A1 May 26, 2011

(30) Foreign Application Priority Data

Aug. 25, 2008 (DE) ..... 10 2008 039 539

(51) Int. Cl.
*B02C 19/00* (2006.01)

(52) U.S. Cl.
USPC ..... 241/101.2; 241/119

(58) Field of Classification Search
USPC ..... 241/117–121, 101.2
See application file for complete search history.

(56) References Cited

U.S. PATENT DOCUMENTS

| | | | | | |
|---|---|---|---|---|---|
| 1,885,251 | A | * | 11/1932 | Gaiser | 241/38 |
| 3,602,070 | A | * | 8/1971 | Verge et al. | 475/177 |
| 4,352,276 | A | * | 10/1982 | Smith | 464/109 |
| 4,896,837 | A | * | 1/1990 | Heinemann et al. | 241/12 |
| 4,909,773 | A | * | 3/1990 | Schlecher et al. | 464/16 |

FOREIGN PATENT DOCUMENTS

| | | | | | |
|---|---|---|---|---|---|
| DE | 3426083 | C1 | * | 10/1985 | B02C 13/30 |
| DE | 3602932 | A1 | | 8/1987 | |
| DE | 19702854 | A1 | | 7/1998 | |
| SU | 1346238 | A1 | | 10/1987 | |
| WO | 00/63587 | A | | 10/2000 | |

OTHER PUBLICATIONS

Machine translation for DE 3602932 (listed in IDS Jan. 25, 2011).*
Translation for SU 1346238 (reference in IDS Jan. 25, 2011).*

* cited by examiner

*Primary Examiner* — Shelley Self
*Assistant Examiner* — Leonel Vasquez
(74) *Attorney, Agent, or Firm* — Renner Kenner Greive Bobak Taylor & Weber

(57) ABSTRACT

A roller mill includes a rotatable grinding table, at least one grinding roller that is retained rotatably on a pivot lever and is in rolling engagement with the grinding table, with the pivot lever being arranged for pivoting about a pivot lever axis, and a drive train associated with the grinding roller in order to drive the grinding roller with a fixed motor.

13 Claims, 4 Drawing Sheets

ROLLER MILL WITH DRIVEN GRINDING ROLLER

TECHNICAL FIELD

The invention relates to a roller mill having a rotatable grinding table and at least one grinding roller which is retained rotatably on a pivot lever and which is in rolling engagement with the grinding table, with the pivot lever being arranged for pivoting about a pivot lever axis.

BACKGROUND OF THE INVENTION

In roller mills used industrially, a grinding table drives grinding rollers via a grinding bed. In this instance, it is generally necessary to arrange a gearing mechanism below the grinding table. In mills having large throughputs, it is necessary to take into account high investment costs, long procurement times and unsatisfactory availability with such gearing mechanisms.

Therefore, it has already been proposed to drive the grinding rollers in place of the grinding table. If a plurality of grinding rollers are provided, it is thereby possible to distribute the power for driving the roller mill over a corresponding plurality of drives. In that manner, it is possible to use drives which are smaller and therefore cheaper.

In DE 38 01 728 C2 and DE 36 02 932 A1, the complete drive with the motor and gearing mechanism is provided on the pivot lever which retains the grinding roller. Owing to the substantial weight of the drive, increased demands are placed on the bearing of the pivot lever in this embodiment. The motor is further subjected to powerful vibrations owing to the grinding process.

DE 197 02 854 proposes a motor which is fixed in position as an alternative construction type. The drive power is transmitted to the gearing mechanism which is secured to the pivot lever via a cardan shaft. That cardan shaft has to ensure angular compensation in the articulations and longitudinal axial compensation in the intermediate shaft. The angular compensation necessary in the cardan shafts results in various displacement angles in the illustrated drive configuration. That drive configuration thereby has the disadvantage that the rotational movement is not transmitted homokinetically, which again results in undesirable vibrations in the system.

SUMMARY OF THE INVENTION

Therefore, an object of the invention is to improve the roller mill having a rotatable grinding table and a grinding roller which is driven via a fixed motor and which is retained on a pivot lever so that system vibrations caused by the drive train of the grinding roller are minimised.

According to the invention, that object is achieved by the features of claim 1.

The roller mill according to the invention substantially comprises a rotatable grinding table, at least one grinding roller which is rotatably retained on a pivot lever and which is in rolling engagement with the grinding table, the pivot lever being arranged for pivoting about a pivot lever axis, and a drive train which is associated with the grinding roller in order to drive the grinding roller with a fixed motor. The drive train has a coupling which is arranged in the pivot lever axis or the extension thereof and which compensates for the pivot movement of the pivot lever.

The arrangement of the coupling in the pivot lever axis or the extension thereof is intended to be understood in that the pivot lever axis intersects with the coupling.

Owing to that arrangement of the drive train, it is possible to use a coupling which allows the rotational movement to be transmitted homokinetically so that the vibrations introduced into the system by the drive train are minimised.

The necessary compensation movement is further minimised and it is consequently possible to use a cheap and maintenance-free compensation coupling.

The motor which is arranged so as to be fixed in position allows the use of generally available standard motors so that the components of the drive train can be acquired more cheaply.

The dependent claims relate to other embodiments of the invention.

According to a preferred embodiment, the coupling is in the form of a torsionally rigid compensation coupling, whereby a long service life can be ensured. That coupling can be formed, for example, by a tooth coupling, a lamellar coupling or a cardan shaft. If a cardan shaft is used, the intermediate shaft is intended to be arranged in such a manner that it is intersected by the pivot lever axis or the extension thereof and the rotational movement can thereby be transmitted homokinetically.

According to an embodiment, the pivot lever is in the form of a hollow shaft, a portion of the drive train being arranged in the hollow shaft. The drive further comprises one or more gearing mechanisms which are optionally arranged so as to be fixed in position and/or arranged on the pivot lever and/or in the region of the grinding roller.

It is further possible to construct at least one gearing mechanism as an epicyclic gear system which is secured to the grinding roller. The epicyclic gear system may be a power-splitting gearing mechanism, in particular a planet gear system.

A pressing system which is in operational contact with the pivot lever can further be provided in order to adjust the pressing pressure of the grinding roller.

According to a preferred embodiment, the pivot lever is constructed in such a manner that it is directed through a mill housing and the grinding roller is retained at the end of the pivot lever that is in the mill housing, whereas the other end is arranged in a bearing outside the mill housing.

The grinding roller is further arranged on the pivot lever with a grinding roller bearing, it being possible for the grinding roller bearing, the bearing of the pivot lever and the coupling to have a common oil chamber.

The grinding roller rotates about a grinding roller axis, the fixed motor being arranged with its motor shaft substantially in extension of the grinding roller axis. However, other arrangements may also be considered. For instance, the drive axis of the fixed motor may also be arranged so as to be offset parallel relative to the grinding roller axis, the drive train being redirected through 180° from the motor to the grinding roller.

BRIEF DESCRIPTION OF THE DRAWINGS

Other advantages and constructions of the invention will be explained in greater detail below with reference to the description and the drawings, in which.

DETAILED DESCRIPTION OF THE INVENTION

Figure 1:
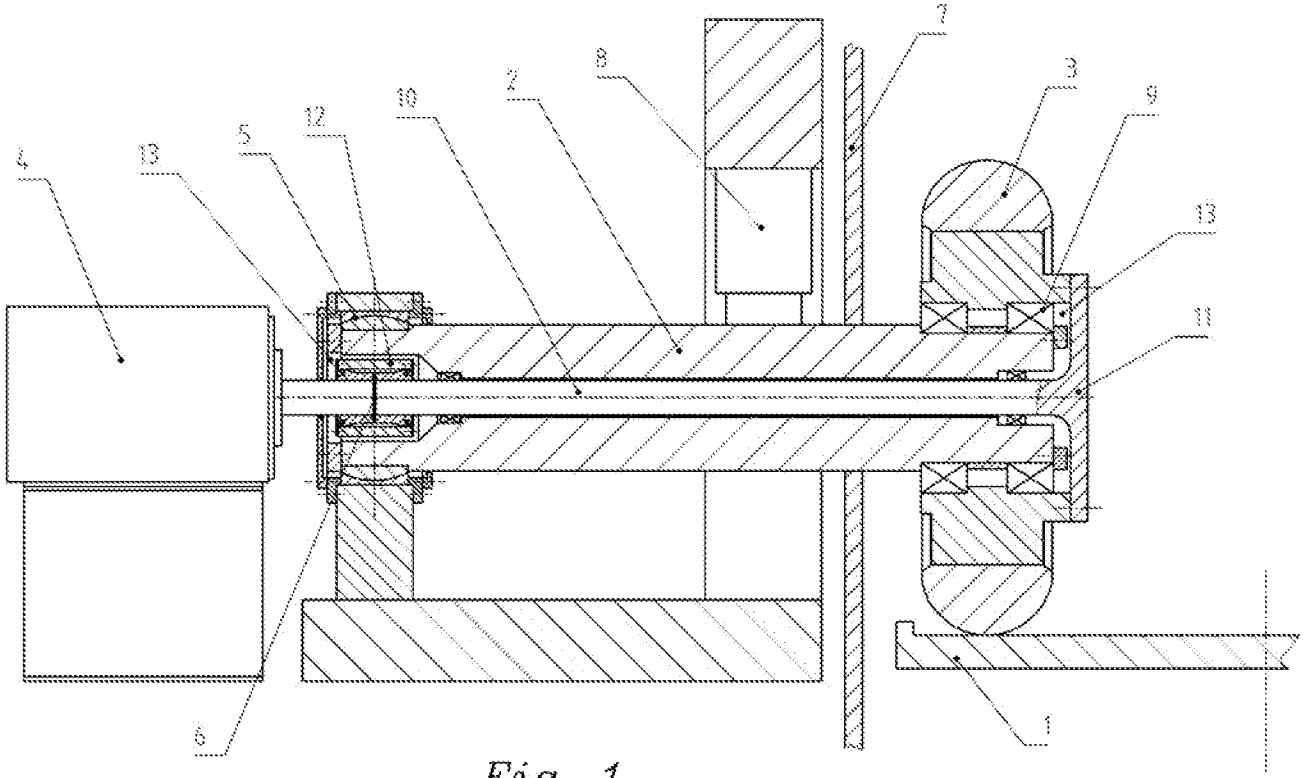
FIG. 1 is a sectional side view of a roller mill in accordance with a first embodiment.

The roller mill illustrated in FIG. 1 substantially comprises a rotatable grinding table 1, at least one grinding roller 3 which is rotatably retained on a pivot lever 2 and a drive train which is associated with the grinding roller in order to drive the grinding roller with a motor 4 which is fixed in position. The pivot lever is arranged in a bearing 5 so as to pivot about a pivot lever axis 6. The pivot lever 2 further extends through a mill housing 7, the grinding roller 3 being retained at the end of the pivot lever located in the mill housing, whereas the other end is arranged in the bearing 5 outside the mill housing.

There is further provided a pressing system 8, in particular a hydropneumatic resilient system, in order to adjust the pressing pressure of the grinding roller 3.

The pressing system is also arranged outside the mill housing 7 and is in operational contact with the pivot lever.

The grinding roller 3 is arranged for rotation on the pivot lever 2 by means of a grinding roller bearing 9. The pivot lever 2 is further constructed as a hollow shaft so that a portion of the drive train is arranged in the form of a drive shaft 10 in the hollow shaft. The rotational movement of the drive shaft is transmitted to the grinding roller 3 via a hub 11. The drive shaft 10 is operationally connected at the other end to the motor 4 which is arranged so as to be fixed in position, one or more gearing mechanisms being able to be interposed. The gearing mechanisms may be both arranged so as to be fixed in position and arranged on the pivot lever. Since a portion of the drive train is constructed so as to be fixed in position and another portion, in particular the drive shaft 10 which is arranged in the pivot lever 2, also pivots with the pivot lever 2, it is necessary to provide a coupling 12 which compensates for the pivot movement of the pivot lever. The coupling 12 is arranged in the pivot lever axis 6 and transmits the rotational movement homokinetically.

The coupling 12 is preferably a torsionally rigid compensation coupling, it being particularly possible to provide a curved-tooth coupling.

According to a specific construction of the invention, the grinding roller bearing 9, the bearing 5 and the coupling 12 have a common oil chamber 13.

Figure 2:
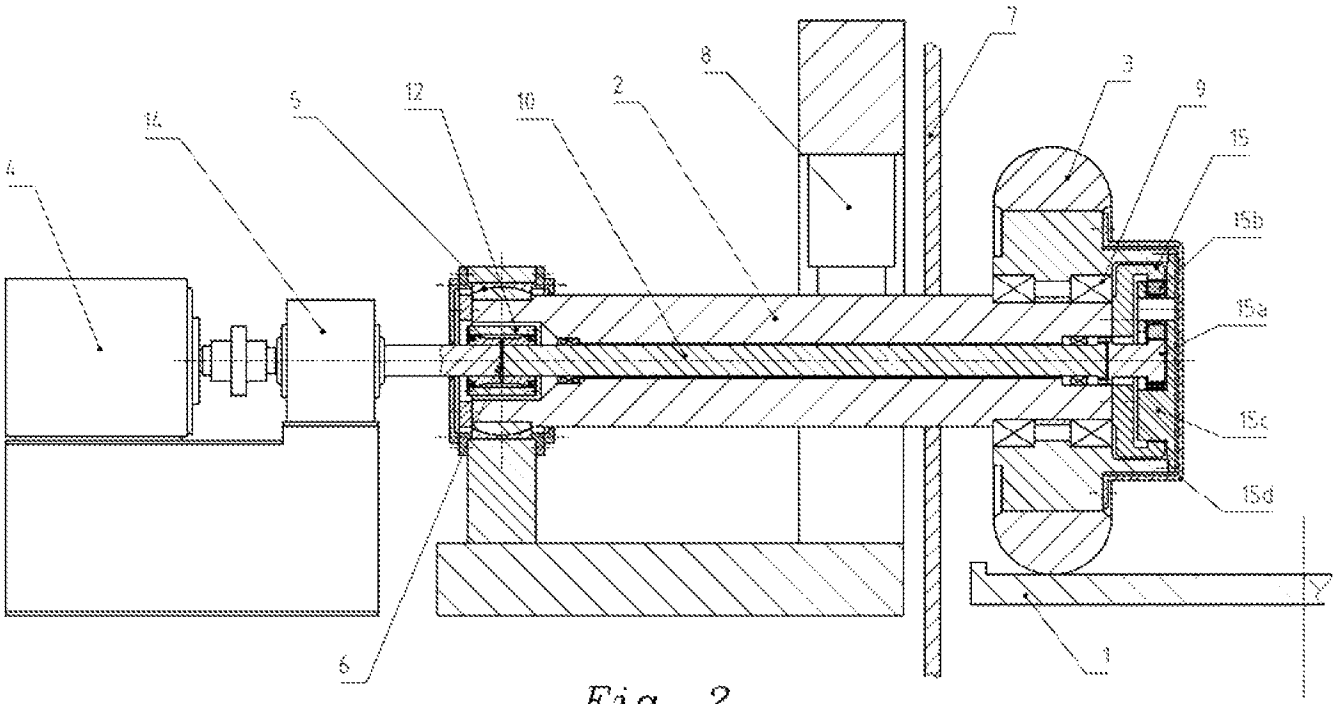
FIG. 2 is a sectional side view of a roller mill in accordance with a second embodiment.

The embodiment according to FIG. 2 substantially differs from the first embodiment only in that there are further provided in the drive train a fixed gearing mechanism 14 and a co-rotating gearing mechanism in the form of an epicyclic gear system 15. The epicyclic gear system 15 is secured to the end of the pivot lever in the region of the grinding roller 3. It is in the form of a power-splitting gearing mechanism, and is constructed as a planet gear system according to a preferred embodiment of the invention.

The epicyclic gear system 15 has, as usual, a sun gear 15*a*, a plurality of planet gears 15*b* and a planet carrier 15*c*. The sun gear 15*a* may be arranged for pivoting movement and is driven via the drive shaft 10. The planet carrier is connected to the grinding roller in a rotationally secure manner. The epicyclic gear system 15 is further protected by means of a wear protection member 15*d* which can preferably be changed. There is further intended to be provided a suitable moment support which could be formed, for example, by lateral guides of the pressing system 8.

Figure 3A:
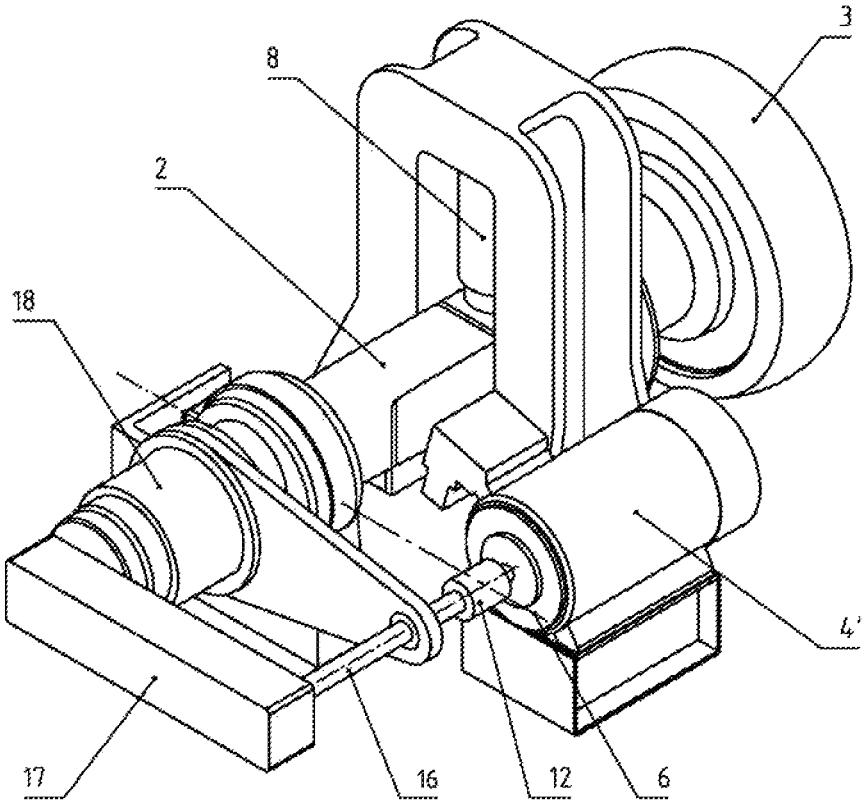
FIG. 3*a* is a three-dimensional illustration of a roller mill in accordance with a third embodiment.
Figure 3B:
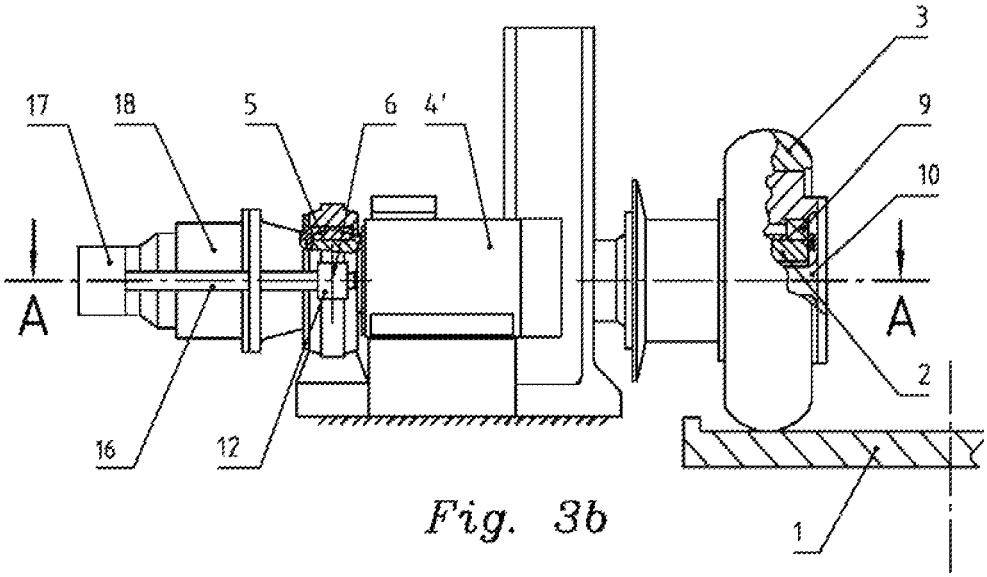
FIG. 3*b* is a side view of the roller mill according to FIG. 3*a* and FIG. 3*c* is a sectional view along line A-A of FIG. 3*b*.
Figure 3C:
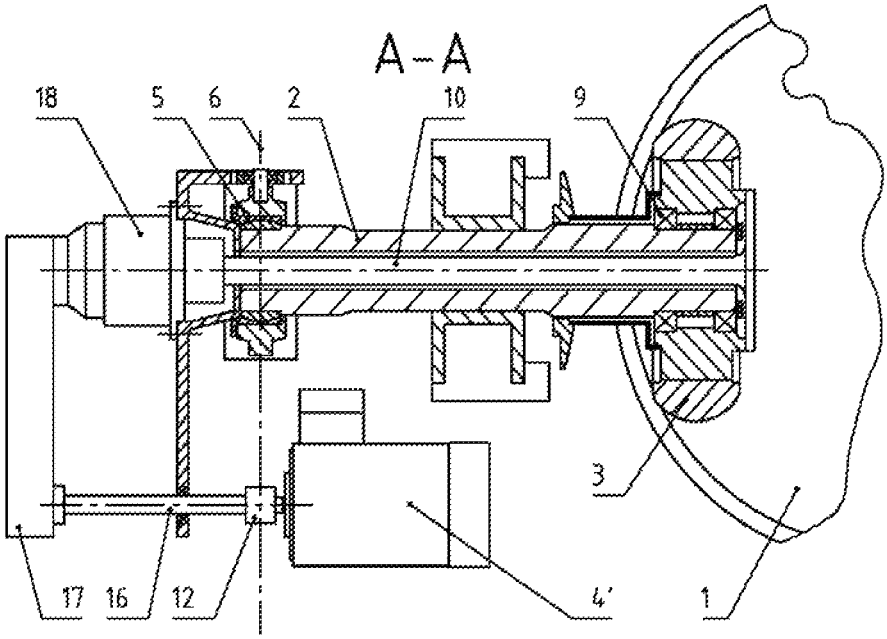

Whilst the fixed motor 4 in the first two embodiments according to FIGS. 1 and 2 is arranged in extension of the pivot lever 2, the fixed motor 4' in FIGS. 3*a* to 3*c* is located laterally beside the pivot lever 2.

In this embodiment, the pivot lever 2 is also in the form of a hollow shaft so that a drive shaft 10 can be arranged in the hollow shaft in order to transmit the rotational movement to the grinding roller 3.

In this embodiment, the drive train also comprises a fixed drive train which is particularly formed by the motor 4' and a drive train which is also moved with the pivot lever 2 and which further comprises, in addition to the drive shaft 10 arranged in the pivot lever 2, an additional shaft 16, a first gearing mechanism 17, in particular a toothed wheel mechanism and, optionally, a second gearing mechanism 18.

There is again provided, at the connection location between the fixed and the movable drive train, a coupling 12 which is also arranged in the pivot lever axis 6 or the extension thereof in this instance. Therefore, the drive train is redirected through 180° from the motor 4', via the shaft 16, the first and second gearing mechanism 17, 18 to the drive shaft 10 which is connected to the grinding roller 3. Owing to the special drive configuration, however, it is also possible in this instance to select a coupling which ensures a homokinetic transmission of the rotational movement so that vibrations of the system caused by the drive train of the grinding roller are minimised.

The invention claimed is:

1. Roller mill comprising:

a. a rotatable grinding table, b. at least one grinding roller rotatably retained on a pivot lever and in rolling engagement with the grinding table, the pivot lever being arranged for pivoting about a pivot lever axis, and c. a drive train associated with the grinding roller and driving the grinding roller with a fixed motor, characterised in that the drive train has a coupling arranged in the pivot lever axis or the extension thereof, the coupling compensating for the pivot movement of the pivot lever.

2. Roller mill according to claim 1, characterised in that the coupling is in the form of a torsionally rigid compensation coupling.

3. Roller mill according to claim 1, characterised in that the coupling is in the form of a tooth coupling.

4. Roller mill according to claim 1, characterised in that the coupling is in the form of a cardan shaft.

5. Roller mill according to claim 1, characterised in that the drive train is redirected through 180° from the motor to the grinding roller.

6. Roller mill according to claim 1, further comprising a pivot lever bearing for the pivoting of the pivot lever, the roller mill characterised in that the grinding roller is arranged on the pivot lever with a grinding roller bearing and the grinding roller bearing, the pivot lever bearing and the coupling have a common oil chamber.

7. Roller mill according to claim 1, characterised in that the pivot lever is in the form of a hollow shaft and a portion of the drive train is arranged in the hollow shaft.

8. Roller mill according to claim 1, characterised in that the drive train comprises a fixed gearing mechanism and a pivoting gearing mechanism that pivots with the pivot lever and/or the grinding roller.

9. Roller mill according to claim 1, characterised in that the drive train comprises at least one gearing mechanism in the form of an epicyclic gear system and secured to the pivot lever in the region of the grinding roller.

10. Roller mill according to claim 9, characterised in that the epicyclic gear system is in the form of a power-splitting gearing mechanism.

11. Roller mill according to claim 9, characterised in that the epicyclic gear system is in the form of a planet gear system.

12. Roller mill according to claim 1, characterised in that the pivot lever is directed through a mill housing, the grinding roller being retained at the end of the pivot lever that is in the mill housing and the other end being arranged in a bearing outside the mill housing.

13. Roller mill according to claim 1, characterised in that a pressing system which is in operational contact with the pivot lever is provided in order to adjust the pressing pressure of the grinding roller.

* * * * *